US005735008A

United States Patent [19]

Mangone

[11] Patent Number: 5,735,008

[45] **Date of Patent: *Apr. 7, 1998**

[54] WELD-FREE GRATINGS FOR BRIDGE DECKS WITH IMPROVED PRIMARY AND SECONDARY BARS

[75] Inventor: Ronald W. Mangone, New Kensington, Pa.

[73] Assignee: Mangone Enterprises, New Kensington, Pa.

[ * ] Notice: The term of this patent shall not extend beyond the expiration date of Pat. No. 5,604,949.

[21] Appl. No.: 681,531

[22] Filed: Jul. 23, 1996

Related U.S. Application Data

[63] Continuation-in-part of Ser. No. 541,732, Oct. 10, 1995, Pat. No. 5,642,549.

[51] Int. Cl.[6] ..... E04C 2/42

[52] U.S. Cl. ..... 14/73; 52/668; 404/70

[58] Field of Search ..... 403/348, 400; 52/664, 668; 14/73, 6; 404/70, 71, 75, 134, 135, 136

[56] References Cited

U.S. PATENT DOCUMENTS

| | | | |
|---|---|---|---|
| 1,426,736 | 8/1922 | Hess | 52/668 |
| 1,744,153 | 1/1930 | Bates | 52/668 |
| 2,073,896 | 3/1937 | Loetscher | 52/668 |
| 2,114,773 | 4/1938 | Augen et al. . | |
| 2,128,753 | 8/1938 | Lienhard . | |
| 2,190,214 | 2/1940 | Nagin . | |
| 2,645,985 | 7/1953 | Beebe et al. . | |
| 2,740,335 | 4/1956 | Greulich | 14/73 |
| 2,834,267 | 5/1958 | Beebe . | |
| 2,918,995 | 12/1959 | Kruger | 52/668 |
| 3,177,990 | 4/1965 | Flucker et al. | 52/668 |
| 3,197,160 | 7/1965 | Murphy | 52/664 |
| 3,260,023 | 7/1966 | Nagin . | |
| 4,452,025 | 6/1984 | Lew | 52/668 |
| 4,780,021 | 10/1988 | Bettigole | 404/72 |
| 4,865,486 | 9/1989 | Bettigole | 14/73 |
| 4,928,471 | 5/1990 | Bartley | 52/664 |
| 5,463,786 | 11/1995 | Mangone et al. | 14/73 |
| 5,509,243 | 4/1996 | Bettigole et al. | 52/334 |
| 5,604,949 | 2/1997 | Mangone | 14/73 |
| 5,642,549 | 7/1997 | Mangone | 404/70 X |

FOREIGN PATENT DOCUMENTS

| | | | |
|---|---|---|---|
| 1010046 | 3/1952 | France | 52/664 |
| 1070137 | 2/1954 | France | 52/664 |
| 28939 | 2/1933 | Netherlands | 52/664 |

*Primary Examiner*—James Lisehora
*Attorney, Agent, or Firm*—Andrew Alexander

[57] ABSTRACT

A weldless grating comprises a plurality of longitudinally extending primary load bearing members having an upper portion having an upper edge, a lower portion and a first web located between the upper portion and the lower portion, the primary load bearing member having a plurality of spaced-apart openings in the first web, the openings in each of the primary load bearing members being aligned with the openings in adjacent primary load bearing members, the openings having a top portion and a bottom portion, at least one of the top portion and the bottom portion having a protuberance extending from the first web into the opening, and a plurality of secondary load bearing members having an upper edge and a lower edge and a secondary web between the upper edge and lower edge, the secondary load bearing members provided with secondary slots in the secondary web. The secondary load bearing members are positioned in the aligned openings in the web of the primary load bearing members, the secondary slots in the secondary load bearing member forming a locking engagement with the protuberances in the openings in the primary load bearing members; and means for maintaining the secondary slots in engagement with the protuberances.

30 Claims, 8 Drawing Sheets

WELD-FREE GRATINGS FOR BRIDGE DECKS WITH IMPROVED PRIMARY AND SECONDARY BARS

CROSS REFERENCE TO RELATED APPLICATIONS

This application is a continuation-in-part of U.S. Ser. No. 08/541,732, filed Oct. 10, 1995, now U.S. Pat. No. 5,642,549.

BACKGROUND OF THE INVENTION

This invention relates to grids or gratings useful for open or filled bridge decks, walkways, drain gratings and the like and more particularly, this invention relates to grids or gratings that are constructed and held together without welding.

In making prior gratings for bridge decks, whether the deck is open or filled with concrete, a certain amount of welding is performed to hold or bind the individual components together. That is, if the grid is used for open grating or open bridge deck, the main load bearing members, secondary load bearing members and tertiary load bearing members are welded together, usually by puddle welding, to hold the members together and give the deck or grating strength. Even if the grid or deck is to be encased in concrete, still some welding is required to hold the assembly in a rigid configuration until the concrete hardens. If only minimal welding is performed, then the deck or grid work when encased in concrete has a decreased level of strength. Thus, for peak bridge strength, the various components of the grating or bridge deck must be fastened together to perform as a unit.

Various deck or grating systems have been proposed in the art, and the members comprising the grating deck are welded together. For example, U.S. Pat. No. 3,260,023 discloses a bridge floor and surfacing component. The bridge floor comprises parallel bearer bars and cross bars. The cross bars are pressure welded into the tops of the bearer bars.

U.S. Pat. No. 4,865,486 discloses a method of assembling a steel grid and concrete deck wherein the primary load bearing bars are formed with openings to receive slotted secondary load bearing bars that are passed through the primary load bearing bars. However, the patent discloses that tack welds are used to temporarily hold the grating in its desired configuration. A concrete component encases at least the top surface of the grating base member and secures the elements of the grating base member together.

U.S. Pat. No. 2,128,753 discloses a steel floor construction having a series of parallel main bars in spaced relationship. Each of the main bars is provided with a plurality of rectangular-shaped openings. The openings are designed to permit the insertion thereon and the positioning of two cross bars. A third set of bar is placed in slots in the cross bars. After the members are assembled, the entire construction may be welded together to maintain the different parts in position.

U.S. Pat. No. 2,190,214 discloses a grating wherein a desired number of parallel spaced apart main bearer bars with intermediate bearer bars of less depth are placed between the main bearer bars. The main bearer bars and intermediate bearer bars are connected at their tops by cross bars secured thereto by electric pressure welding. Carrier bars which pass through slots in the main bearer bars are welded to the intermediate bearer bars. Also, carrier bars are welded to the main bearer bars.

U.S. Pat. No. 2,645,985 discloses an open floor grating having a plurality of longitudinal primary members, a plurality of transverse secondary members welded to and extending between the primary members. A plurality of tertiary members are welded to the secondary members. A rod is inserted through holes in the webs of the primary members and welded thereto.

U.S. Pat. No. 2,834,267 discloses a grating comprised of a plurality of spaced parallel main longitudinal bars and a plurality of spaced parallel lacing bars and tertiary longitudinal bars intermediate the main bars. Bottom bars are inserted through holes in the webbing of the main bars. The intersection between the lacing bars and the tertiary bars are welded and the bottom bar is welded to the webbing of the main bar.

U.S. Pat. No. 4,452,025 discloses a self-interlocking grille consisting of a plurality of metallic or plastic strips or flats or bars with certain types of notches and holes disposed along the length of the strip or flats or bars in a regular interval, which are used together with a plurality of rods in assembling a variety of interlocking grills.

U.S. Pat. No. 4,780,021 discloses an exodermic deck conversion method for converting a conventional grid deck to an exodermic deck. Tertiary load bearing bars are placed on top of the grating parallel to and between the primary load bearing bars. A plurality of shear connectors, such as vertical studs, are welded or attached to the surface of the grating. It will be seen from the above that in gratings and bridge decks, usually some form of welding or cement is used to hold the assembly together.

However, welding gratings or deck structures have the problem that toxic fumes are released into the atmosphere causing health hazards to the welders and pollution of the environment. Welding of structures such as bridge decks results in curling or deforming of the deck as the welds cool. Thus, the design of the deck is complicated in that the curling or deforming must be accommodated in the design. Further, welding has the disadvantage that it is time consuming and often is the rate-determining step at which decks can be built. Welding also requires that the gratings or deck assemblies be maintained in jigs prior to starting the welding process. This is an additional, undesirable step in the process of making a bridge deck. Further, welds on bridge decks have the problem of cracking either with use or as the temperature cycles between winter and summer. It is desirable to rustproof gratings by galvanizing. However, because galvanizing is destroyed by welding, the welded grating or deck is often galvanized as a unit. However, this also results in temperature cyclization and warping of the bridge deck with the result that welds often break, detrimentally affecting the integrity of the deck.

Thus, it will be seen that there is a great need for an improved bridge deck or grating which will eliminate these problems and will provide for an improved deck or grating structure. The present invention provides such a structure.

SUMMARY OF THE INVENTION

It is an object of the present invention to provide an improved grating.

It is another object of the invention to provide a grating suitable for use on bridge decks.

It is a further object of the invention to provide an interlocking grating fastened together without need for welding.

Still, it is another object of the invention to provide an interlocking grating which may be used for open bridge decks or may be utilized with a concrete component that encases at least a top portion of the grating.

Yet, it is a further object of the invention to provide an interlocking grating for bridge decks and the like employing a primary load bearing member and a secondary load bearing member securely held together without welding.

And yet, it is an additional object of the invention to provide an interlocking grating for open or concrete encased bridge decks and the like employing a primary load bearing member, a secondary member and a tertiary load bearing member held together without welding.

These and other objects will become apparent from the drawings, specification and claims appended hereto.

In accordance with these objects, there is provided a grating comprising: (a) a plurality of longitudinally extending primary load bearing members having an upper portion, a lower portion and a web located between the upper portion and the lower portion, the primary load bearing member having a plurality of spaced apart openings in said web, the openings in each of said primary load bearing member being aligned with the openings in adjacent primary load bearing members; (b) a plurality of secondary load bearing members having an upper edge and a lower edge, the secondary load bearing members provided with first slots extending downwardly through the upper edge to provide top slots and with upwardly extending slots through the lower edge to provide bottom slots located substantially opposite the top slots, the secondary load bearing members positioned in the aligned openings in the web of the primary load bearing members, the top and bottom slots in the secondary load bearing member forming a locking engagement with the web surrounding the openings in the primary load bearing members, the secondary load bearing members having a width and provided with secondary downwardly extending slots through the upper edge, secondary downwardly extending slots located between primary load bearing members, the secondary downwardly extending slots having an upper portion extending downwardly from said upper edge and a lower portion located below the upper portion, the upper portion having a first extent and the lower portion having a second extent, the first extent being greater than the second extent; (c) a plurality of tertiary load bearing members positioned in the secondary slots in the secondary load bearing members, the tertiary load bearing member having a width slightly smaller than the first extent to provide a snug fit therewith; and (d) a rod extending through the tertiary load bearing members and the primary load bearing members locking the tertiary load bearing members in the slots in the secondary load bearing members and locking the secondary load bearing members in the openings in the primary load bearing members to form the grating.

DETAILED DESCRIPTION OF PREFERRED EMBODIMENTS

Figure 1:
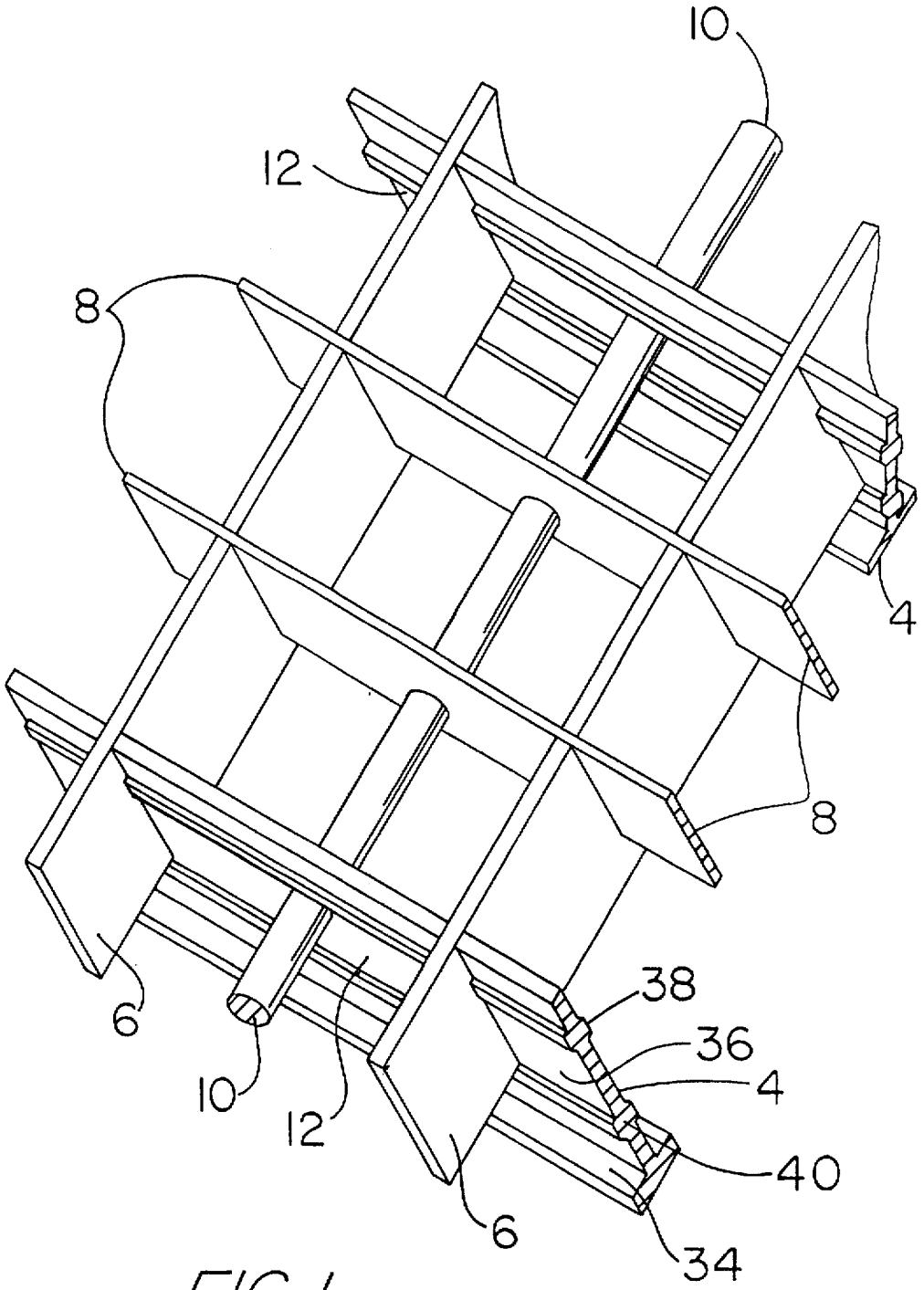
FIG. 1 is a perspective view of a grating in accordance with the invention showing a secondary load bearing member locked in the web of a primary load bearing member.

Referring now to FIG. 1, there is shown a grating in accordance with the present invention. Grating or grid 2 is comprised of a plurality of primary load bearing bars 4, a plurality of transverse secondary bars 6, a plurality of tertiary bars 8 shown running substantially parallel to the primary load bearing bars 4. A rod 10 is shown laced through web 12 of primary load bearing bar 4 and through tertiary bars 8.

Figure 2:
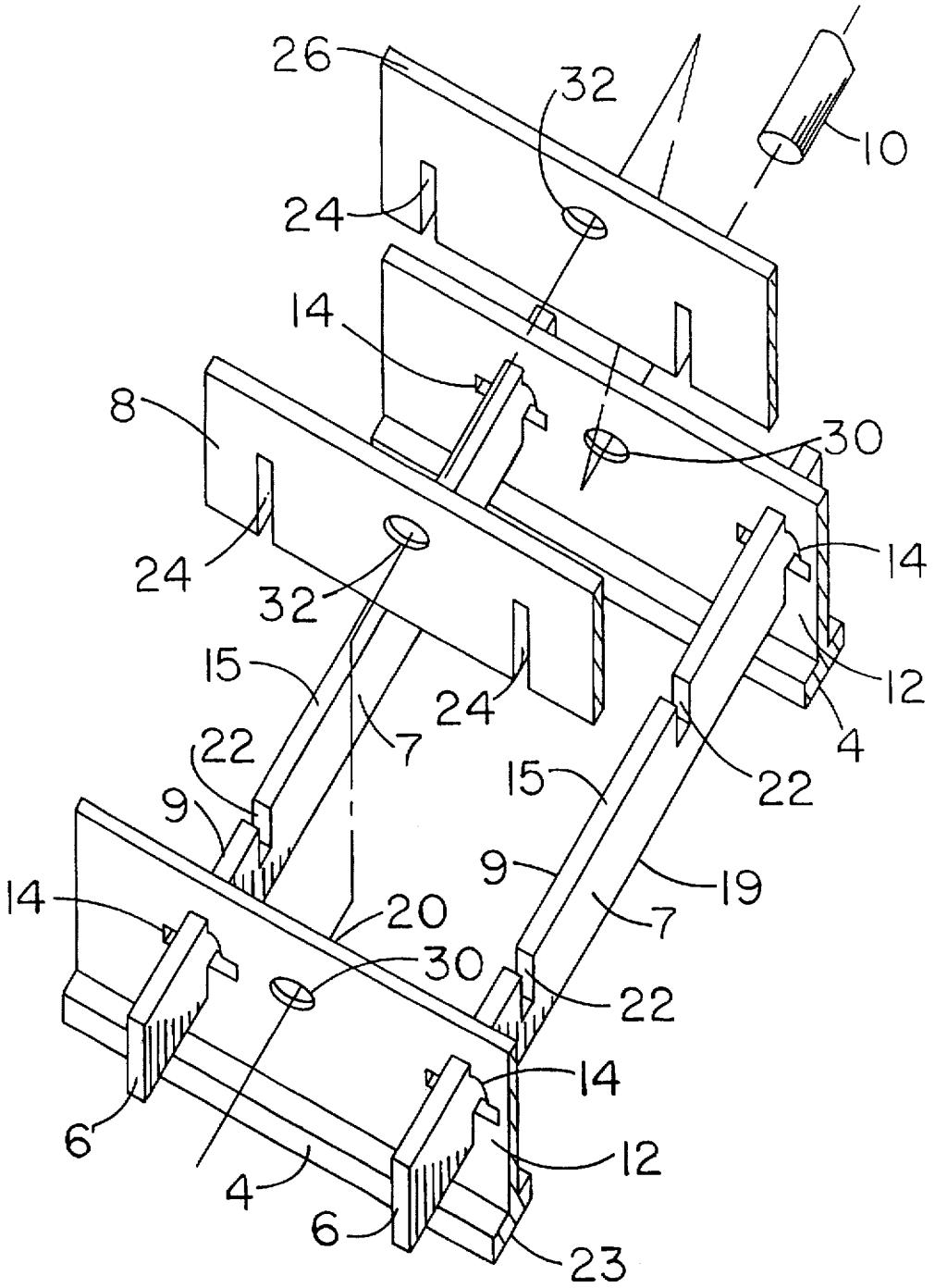
FIG. 2 is a perspective view showing the parts of the grating of FIG. 1 in unassembled relationship.
Figure 7:
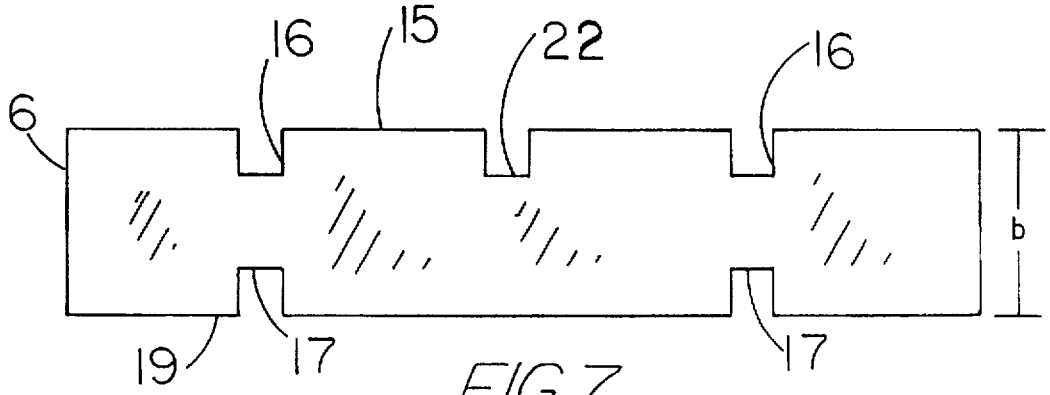
FIG. 7 is a side view of the secondary load bearing member in FIG. 6.
Figure 8:
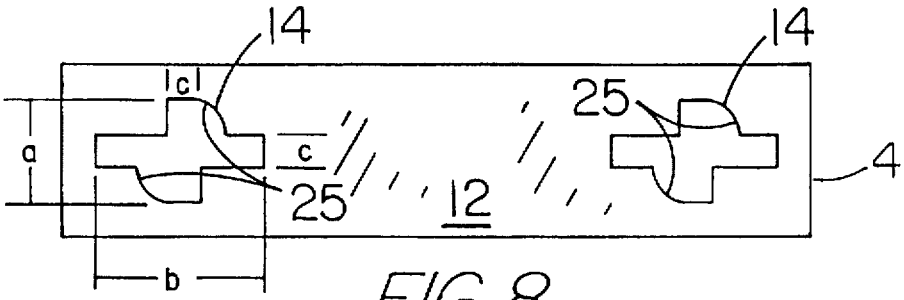
FIG. 8 is a side view of the primary load bearing member with openings in the web for receiving primary load bearing members.

In FIG. 2, the primary load bearing bars 4 and transverse or secondary load bearing bars 6 are shown in partial unassembled relationship along with tertiary bars or tertiary load bearing members 8 and rod 10. It will be seen that primary load bearing bars 4 have openings 14 (see FIG. 8) cut out to receive secondary bar 6. Openings 14 can have different configurations, one of which is shown in FIG. 8. Thus, each primary load bearing bar 4 has a plurality of openings 14 to receive each secondary load bearing bar 6. Further, each secondary load bearing bar 6 has a plurality of slots 16 and 17 (see FIG. 7) that align with openings 14 in primary load bearing bar 4 when assembled.

With respect to secondary load bearing members 6, these are shown having a generally rectangular cross-sectional configuration for convenience. However, other cross-sectional shapes may be utilized. Secondary load bearing members 6 are shown in FIG. 7 in a preferred embodiment having three slots 16 and 22 on top surface 15 and two slots 17 on bottom surface 19. Slots 16 and 17 are positioned opposite each other so as to engage web 12 of primary load bearing member 4 when secondary load bearing member 6 is turned to a vertical position, as explained later. Further, secondary load bearing member 6 is provided with a slot 22 to engage tertiary load bearing member 8 when the grating is assembled. Slots 16, 17 and 22 are formed to provide a snug fit when engaged or locked with web 12 and tertiary load bearing member 8. Further, these slots may be tapered from edge, e.g. 15, to the bottom of the slot to provide for improved engagement and minimize play between the mating members. In certain applications, slots 22 may be eliminated provided a sufficiently deep slot is provided in the bottom side of the corresponding tertiary load bearing member 8.

Figure 6:
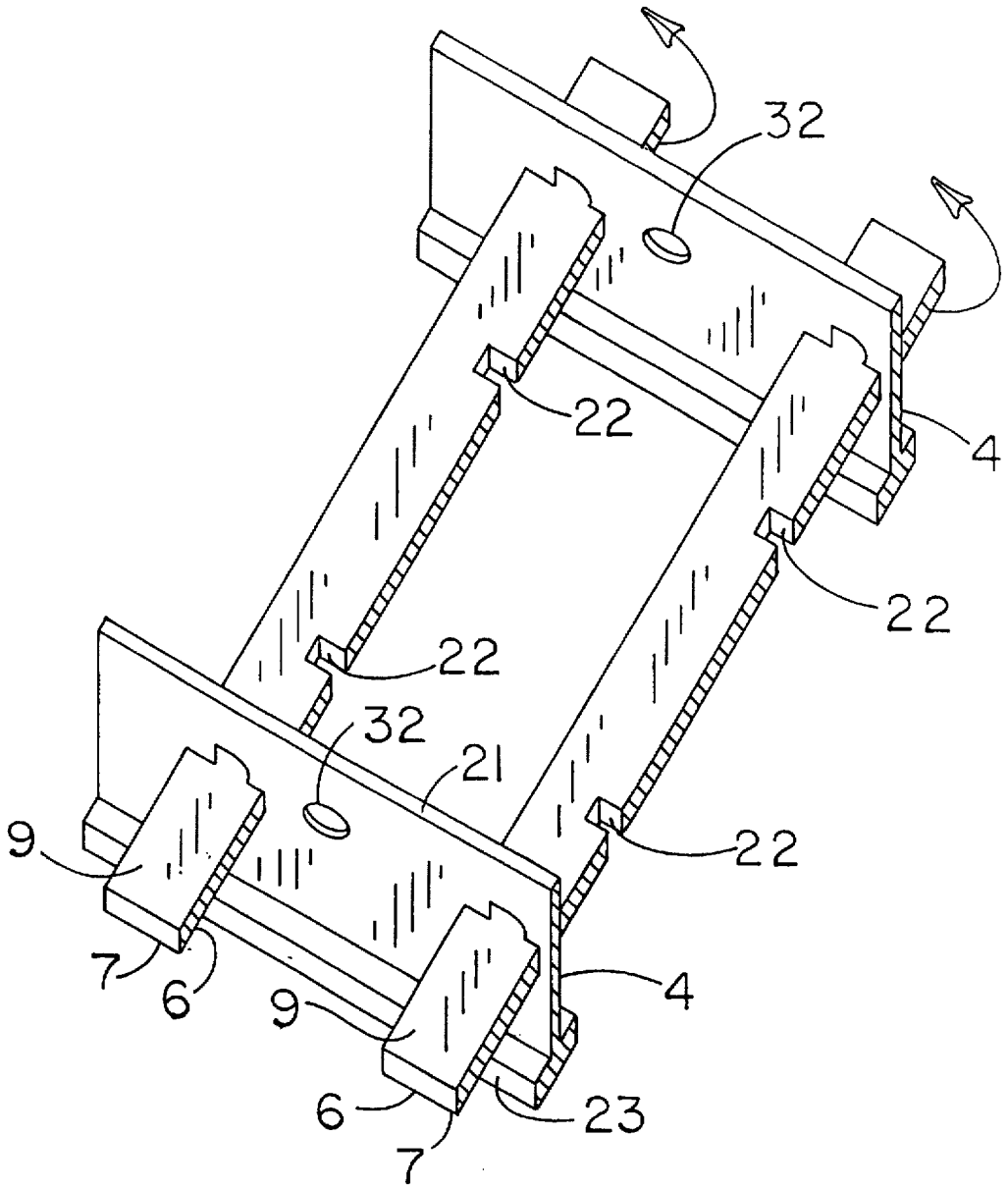
FIG. 6 is a perspective view illustrating partial locking of secondary load bearing members into primary load bearing members.

Primary load bearing member 4 is generally rectangular in cross-section and may have ribs or flanges projecting from either or both sides. FIG. 8 shows a side view of a primary load bearing member 4 showing openings 14 formed in web 12. Two openings are shown for illustration purposes. For purposes of locking secondary load bearing member in primary load bearing member 4, secondary load bearing member 6 is inserted on its side into primary load bearing member 4 as illustrated in FIG. 6. Thus, extent b of opening 14 must be at least slightly larger than height d of secondary load bearing member 6. Also, extent c of opening 14 must be just slightly larger than the thickness of secondary load bearing member 6. When opening 14 has these dimensions, then secondary load bearing member 6 can be inserted on its side through opening 14 until alignment with slots 16 and 17 are reached, as shown in FIG. 6.

In opening 14, the extent or dimension represented by "a" is smaller than the dimension represented by "b" in order that secondary load bearing member locks in web 12. Further, the "a" dimension is preferably slightly larger than the "d" dimension in secondary load bearing member 6 which extends from the bottom of slot 16 to the bottom slot 17. However, the closer the tolerance maintained between these two dimensions, the more rigidity is maintained in the grating. It will be appreciated that there is a balance in the tolerances of all the slots and thickness of material inserted therein and ease of assembly of the grating. That is, the tighter the tolerances maintained, the more rigid the grating. It should be noted that openings 14 are provided with a ramp or land 25 by removal of web material to permit secondary load bearing member 6 to be turned and locked in web 12.

For purposes of illustrating the assembly of weldless grating 2 in accordance with the invention, in one embodiment, secondary load bearing members 6 are laced through openings 14 in primary load bearing members 4. In the method of lacing secondary load being members 6 through primary load bearing members 4, secondary load bearing member 6 is turned on its side. That is, as shown in FIG. 6, side 7 of secondary load bearing member 6 is located underneath and side 9 is located on the top. After secondary load bearing member 6 is inserted through openings 14 to the extent where slots 16 and 17 (FIG. 7) coincide or align with web 12, secondary load bearing member 6 is rotated counter clockwise (FIG. 6) where sides 7 and 9 are in a substantially vertical position. In this position, web 12 is engaged by or inserted into slot 16 on top edge 15 of secondary load bearing member 6. Also, concurrently therewith, web 12 is engaged by or inserted into slot 17 (FIG. 7) on bottom edge 19 of FIG. 7. Thus, web 12 is engaged by or locked into slot 16 on the top of edge 15 of secondary load bearing member 6 and also engaged by or locked into slot 17 on bottom edge 19 of secondary load bearing member 6. While secondary load bearing member 6 is maintained in an upright position as shown in FIGS. 1 or 2, then the top 20 and bottom 23 of primary load bearing member 4 is prevented from moving in the direction of adjacent primary load bearing member 4. In this embodiment of the invention, secondary load bearing member 6 is maintained in a substantially vertical position by use of tertiary load bearing member 8 (FIGS. 1 and 2).

It should be noted that different shapes may be used for opening 14 and different methods of assembly may be used. For example, secondary load bearing bar 6 may be turned clockwise instead of counterclockwise. Further different methods of interlocking may be employed. All of these are contemplated within the purview of the invention.

Figure 11:
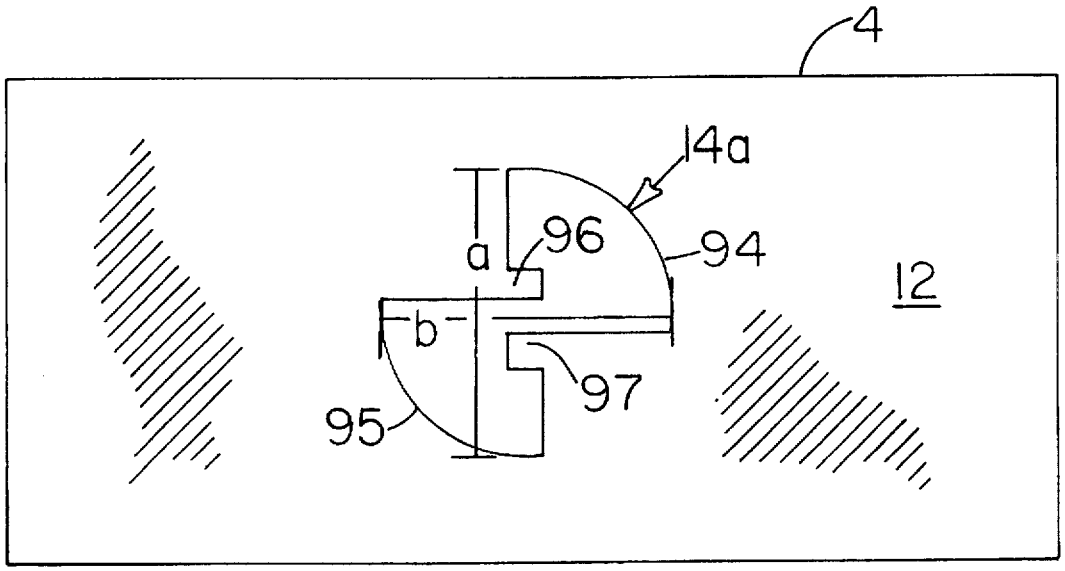
FIG. 11 is a perspective view of a preferred shape of an opening for interlocking two load bearing members.

A preferred opening **14*a* is shown in FIG. 11. It will be seen that opening 14*a* provided in web 12 of primary load bearing member 4 has a generally cross-shaped configuration as represented by the dimension or extent "a" and "b". It should be noted that the dimension represented by "b" is substantially equal to the dimension represented by "a". It will be seen that opening 14*a*** is represented by or generally comprised of two quarter circles which are located substantially opposite each other or as shown generally represent quadrant I and III of a circle.

Figure 12:
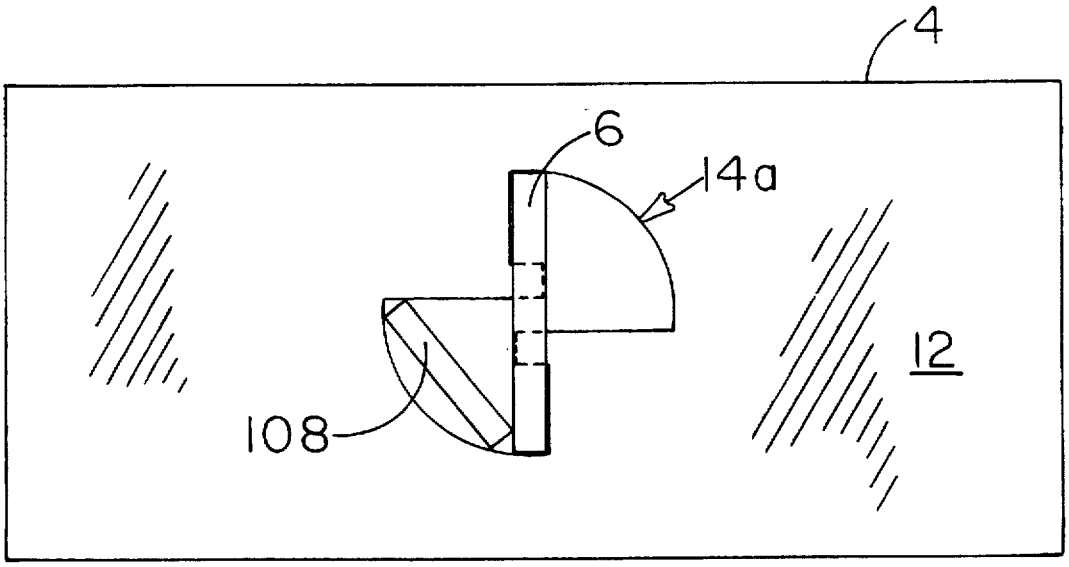
FIG. 12 is a view illustrating two load bearing members interlocked in accordance with the invention.

In the embodiment shown in FIG. 11, extent "b" is required to be sufficiently long to permit the introduction of secondary load bearing member 6 therethrough on the horizontal, and extent "a" is required to be sufficiently long to permit secondary load bearing member 6 to be turned upright as shown in FIG. 12. Further, it should be noted that opening **14*a* is provided with curve portions 94 and 95 which permit secondary load bearing member 6 to be turned to an upright position as shown in FIG. 12. Curve portions 94 and 95 are located in substantially opposing relationship. Opening 14*a* is provided with two protuberances 96 which projects from first face 96*a* and 97 which projects from second face 97*a*. These protuberances are provided to engage an opening or openings in first side 96*b* and second side 97*b* in secondary load bearing member 6. Protuberances 96 and 97 when engaging secondary load bearing member 6 prevent secondary load bearing member 6 from moving in a lateral direction relative primary load bearing member 4**.

Figure 15:
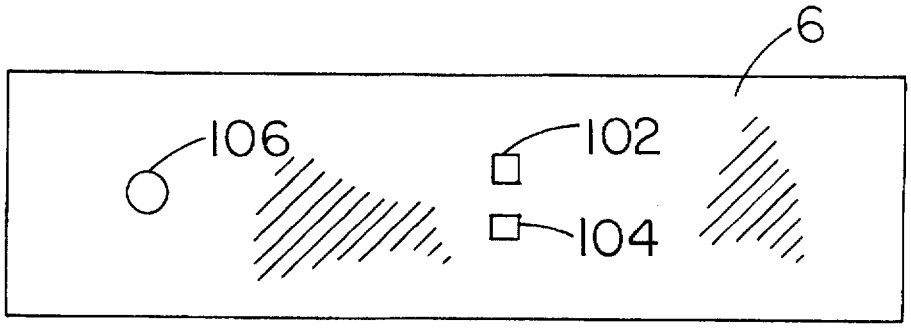
FIG. 15 is a view showing slotted openings in a secondary load bearing member for interlocking in the opening of a primary load bearing member.

A suitable secondary load bearing member 6 is shown in FIG. 15. Secondary load bearing member 6 is shown in FIG. 15. Secondary load bearing member 6 (FIG. 15) is shown with two openings or apertures 102 and 104 which are located or positioned to coincide with and engage protuberances 96 and 97 when secondary load bearing member 6 is inserted into opening **14*a* (FIG. 11) and then turned counter-clockwise to a vertical position as shown in FIG. 12. That is, in assembly, secondary load bearing member 6 is inserted along extent "b" until openings 102 and 104 coincide with protuberances 96 and 97. Then, secondary load bearing member 6 is rotated in a counter-clockwise direction until protuberance 96 fits into opening 102 and protuberance 97 fits into opening 104. This provides a locking engagement of secondary load bearing member 6 in web 12 of primary load bearing member 4. Thus, secondary load bearing member 6 cannot move lateral with respect to primary load bearing member 4**.

While openings 102 and 104 have been shown as separate openings, they may be joined by removing the material between openings 102 and 104 to provide a single slot that will accommodate both protuberances 96 and 97.

In addition, because the grating of the subject invention does not require welds and may be assembled on site, for example, at a bridge site to minimize shipping costs, it is important that it be capable of assembly without a jig as is normally required for welded decks or grating. Thus, it is important that the members comprising deck or grating remain in place until locking is accomplished. Thus, for example, to facilitate assembly, it is important that secondary load bearing member 6 remain in the upright position in opening **14*a* until additional secondary load bearing members 6** are positioned in the upright position and until they are locked in position.

Figure 13:
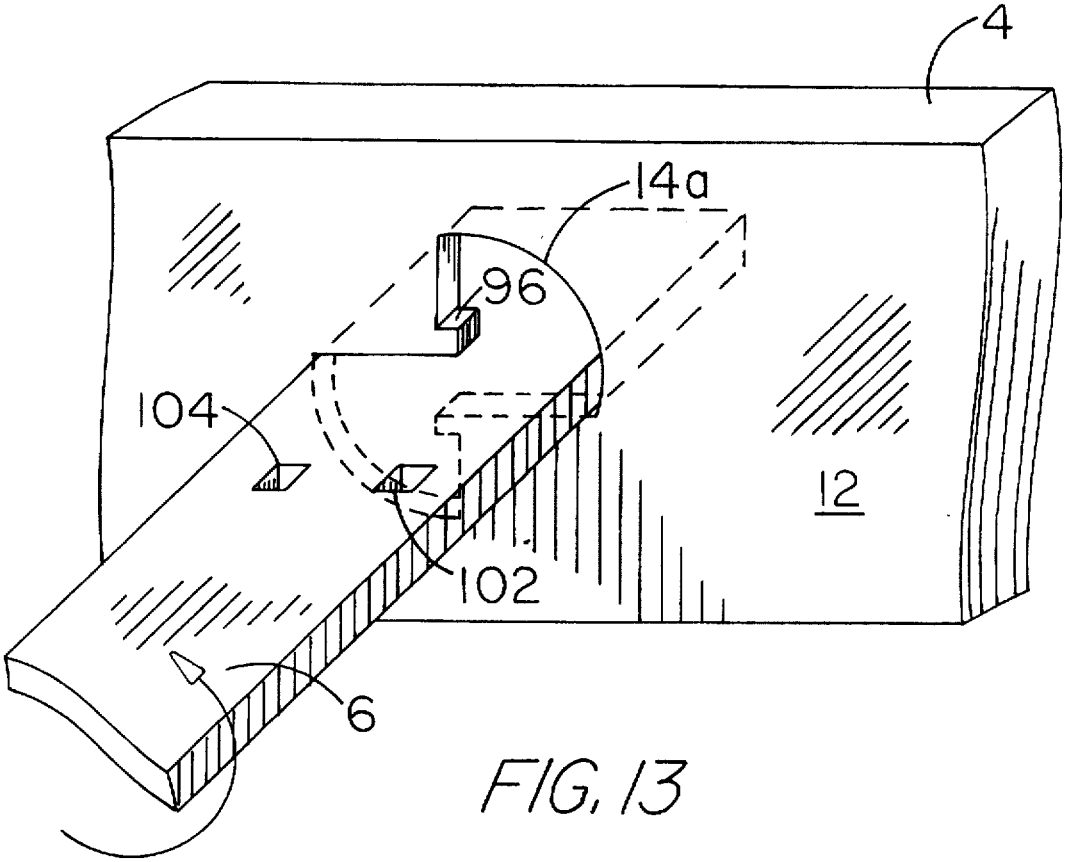
FIG. 13 is a schematic showing a first load bearing member having a preferred opening and a second load bearing member being inserted into the opening, the second member suited for locking in the first member.

FIG. 13 shows in greater detail the fitting or assembly technique required when sliding secondary load bearing member 6 into opening 14a in web 12 of primary load bearing member 4. As shown in FIG. 6, secondary load bearing member 6 is positioned first in a horizontal plane for insertion into opening 14a. This is the preferred method. However, opening 14a may be formed so that extend "b" is not horizontal but formed at an angle to the horizontal plane. Vertical extent "a" is preferred to remain in the upright position in order to obtain the highest strength level from secondary load bearing member 6, particularly when secondary load bearing member 6 has a rectangular configuration. Secondary load bearing member 6 is inserted to the point where all openings 102 and 104 are aligned with all the protuberances 96 and 97 in web 12. When secondary load bearing member 6 is rotated upwardly, slot 16 engages web material above ramp 70 and likewise slot 17 engages web material below ramp 72.

Figure 14:
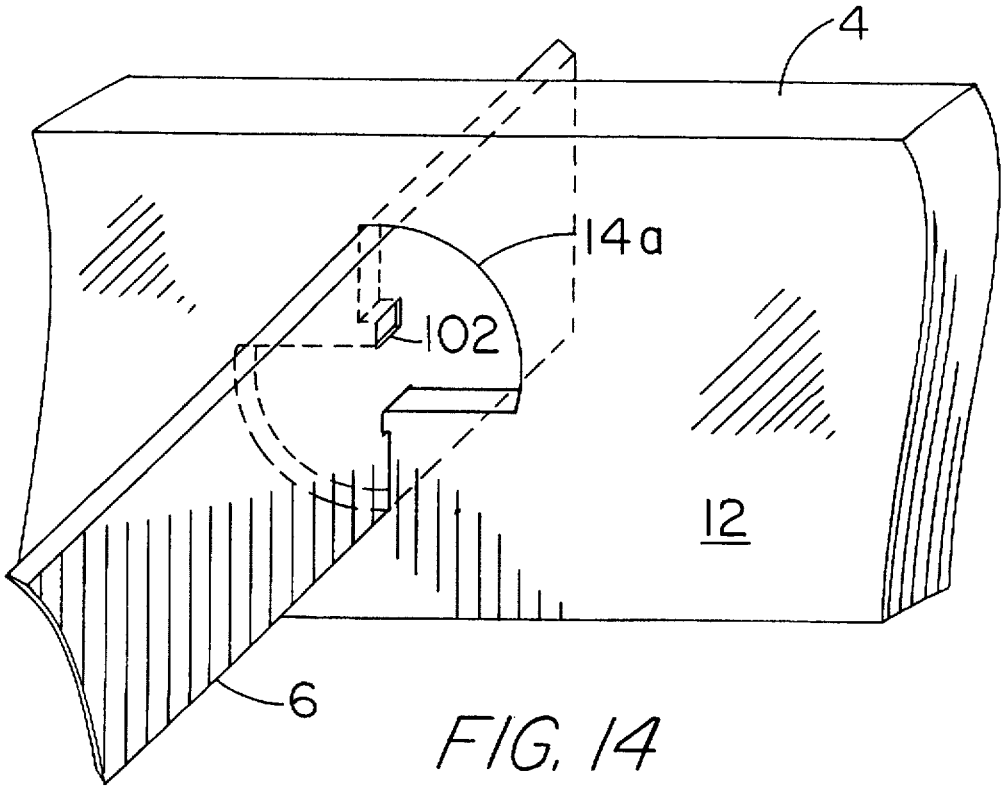
FIG. 14 is a schematic representation showing second load bearing member locking in the first load bearing member utilizing the preferred opening and locking mechanism of the invention.

In FIG. 14, secondary load bearing member 6 is shown in the upright position locked in web 12 of primary load bearing member 4 by protuberances 96 and 97 and openings 102 and 104. When protuberances 96 and 97 engage openings 102 and 104 to provide a snug fit, then primary load bearing member 4 remains fixed in position and substantially parallel to the adjacent primary load bearing members.

For purposes of locking the assembly comprised of primary load bearing bar or member 4, secondary load bearing bars or members 6 and tertiary load bearing bars or members 8, an aperture 30 is provided in primary load bearing bars or members 4 between secondary load bearing bars or members 6, the aperture being formed to have an axis substantially parallel to secondary load bearing bars or members 6. Likewise, tertiary load bearing bars or members 8 have apertures 32 formed so as to be in alignment with apertures 30 of primary load bearing bars or members 4. Rod 10 then is fired through a first aperture 30 in a first primary load bearing bar or member 4, then through apertures 32 of tertiary load bearing bar 8 and finally through a second aperture 30 in second primary load bearing bar or member 4. In this assembly, end 5 of rod 10 may be bent, fitted with a pin or nut to ensure that it does not move. Thus, after having secured rod 10, primary load bearing bars or members 4, secondary load bearing bars 6 and tertiary load bearing bars or members 8 are locked together to form a unit grating, grid work, fence or railings without the attendant problems inherent with welding. Further because of the additional rod used, the strength of the grating structure is improved dramatically. It will be appreciated that one rod or more can be used between each set of secondary load bearing bars or members 6. Further, fewer rods can be used. That is, in the present invention rods 10 can be selectively placed between secondary load bearing bars or members 6. For example, in the present invention, high strength grating can be obtained when rods 10 are used between every other set of secondary load bearing bars or members 6.

With respect to rod 10, it will be noted that a round bar has been illustrated. However, any cross-sectional configuration may be used.

In FIG. 1, primary load bearing bar or member 4 is shown with a lower flange 34, a web portion 12, a bulbous portion 38, and a rib 40. However, primary load bearing bars or members 4 can have other cross-sectional configurations that may be used. In the embodiment shown in FIG. 1, rib 40 and flange 34 provide for special features as explained herein.

Secondary load bearing bars or members 6 can have a depth generally less than the depth of primary load bearing bars or members 4, and tertiary load bearing bars or members 8 can have a depth less than the depth of secondary load bearing bars or members 6. Further, it should be noted that if tertiary load bearing bars or members 8 are sufficiently deep, then notch or slots 24 may be of sufficient depth to accommodate the full depth of the secondary load bearing bars or members 6 without slots 22 being provided in secondary load bearing bars or members 6. Rod 10 can provide sufficient resistance to sideways movement of tertiary load bearing bars or members 8.

For proposes of locking secondary load bearing member 6 as described in FIGS. 11–15 in an upright position or in engagement with protuberances 96 and 97, a slotted tertiary member 8 may be utilized as shown in FIG. 2 where slots 24 engage the secondary load bearing member 4. Further, a rod 10 may be used to hold tertiary load bearing member 8 in position, the rod being passed through apertures 30 and 32, as shown in FIG. 2. In the embodiment described in FIGS. 11–15, it is preferred that secondary load bearing member 6 be free of top or bottom slots substantially as shown in FIG. 15.

In another method of locking secondary load bearing member 6 in an upright position so as to maintain engagement with protuberances 96 and 97. Secondary load bearing member 6 is provided with an aperture or opening 106. Apertures 106 are aligned with apertures in adjacent secondary load bearing member 6. A rod, such as rod 10 in FIG. 2, is then laced through apertures 106, and thus secondary load bearing member 6 is maintained in an upright position.

In yet another method of locking secondary load bearing member 6 in an upright position, a key 108 (FIG. 12) may be inserted after secondary load bearing member 6 is rotated into the upright position. Key 108 may extend across all the primary load bearing members or it can be placed in several members 4.

Lastly, secondary load bearing member 6 may be maintained in the upright position by an interference or friction fit. That is, extent "a" can be made to a tolerance relative to secondary load bearing member 6 such that tools are required to force it into the upright position. These methods for maintaining secondary load bearing member 6 in the upright position are satisfactory until the grating formed therefrom is encased in concrete.

The grating described in FIGS. 11–15 has the advantage that neither the top or bottom of secondary load bearing member 6 is slotted. Thus, there is eliminated possible sites where cracking of the member may occur. This grating has yet another advantage in that a weldless grating can be fabricated using only two rails, if desired.

Figure 3:
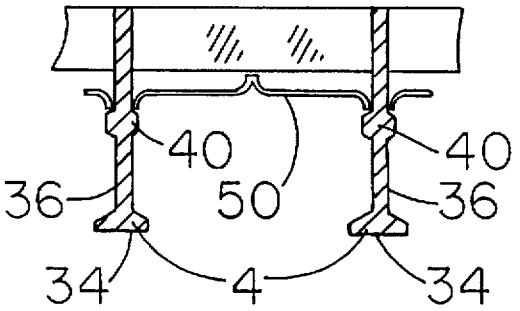
FIG. 3 is an end view along the primary load bearing members showing a pan mounted on upper ribs of the primary load bearing members to contain wet concrete.
Figure 9:
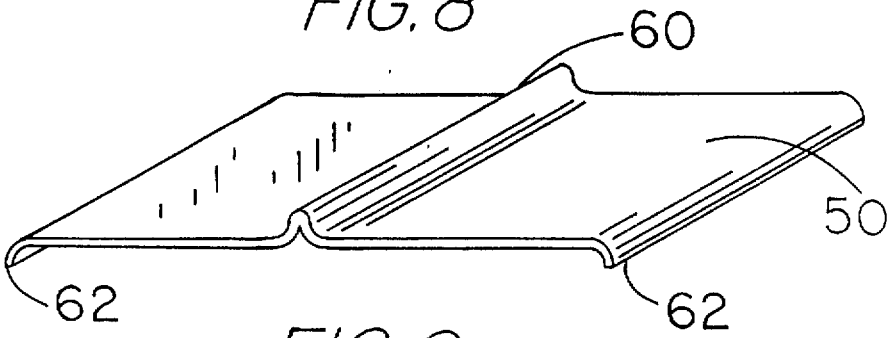
FIG. 9 is a perspective view of the pan of FIG. 3.
Figure 10:
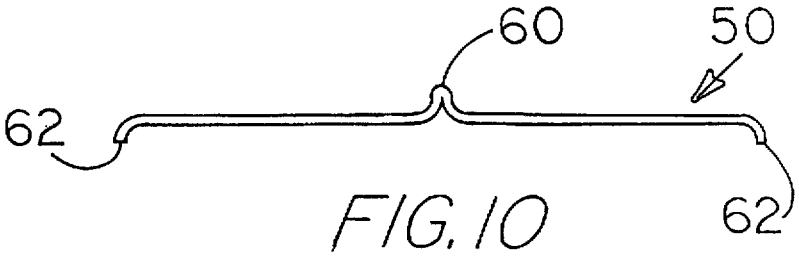
FIG. 10 is an end view of the pan of FIG. 3.

When it is desired to encase at least a portion of the grating in concrete, a pan or sheet member 50 is positioned between primary load bearing bars 4 as shown in FIG. 3. Pan 50 is formed to extend the length of primary load bearing bars 4 and to rest on ribs 40. Thus, pan 50 is preferably shaped substantially as shown in FIGS. 9 and 10. That is, pan 50 is provided with a rib 60 which extends the length of the pan in a direction generally parallel to primary load bearing member 4. Further, preferably pan 50 is generally curved or shaped concave upwardly towards fib 60 as shown in FIGS. 9 and 10. Rib 60 provides for stiffness in the pan. In addition, from edge 62 to the top of ridge 60 should be controlled. That is, in the preferred embodiment, when concrete is to be used as a wear surface or to partially encapsulate grating 2, pan 50 is positioned between primary load bearing member 4 prior to secondary load bearing member 6 being turned to an upright position. Edges 62 of pan 50 rest on the upper surface of rib 40, as shown in FIG.

3, for example. When secondary load bearing member 6 is turned into locking position, bottom or lower side 19 of secondary load bearing member 6 contacts ridge 60 sufficiently to secure pan 50 in place by friction. Thus, the grating can be shipped to the job site without pans 50 moving or dropping out of the grating. It should be noted that welding pans 50 in place is undesirable because of wattage that occurs. The warpage results in uneven thickness of concrete and also in spaces between the fib and the pan which results in wet concrete seeping or dripping onto the surfaces below. The assembled grating in accordance with the invention has a rigid configuration without substantially any movement of the bars or members. Thus, for example, because primary load bearing bars do not move or wobble, the pans can be placed on or inserted between the primary load bearing bars prior to shipping.

Figure 4:
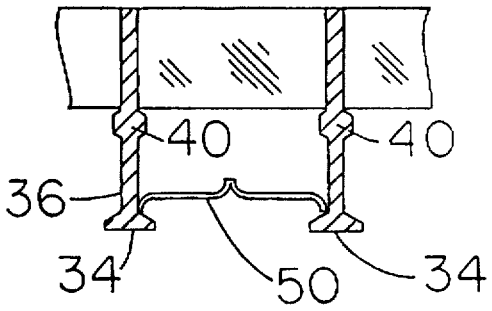
FIG. 4 is an end view along the primary load bearing members showing a pan mounted on lower ribs of the primary load bearing members to contain wet concrete.

If it is desired to encase substantially the depth of the grating in concrete, pan 50 can be located, as shown in FIG. 4.

Figure 5:
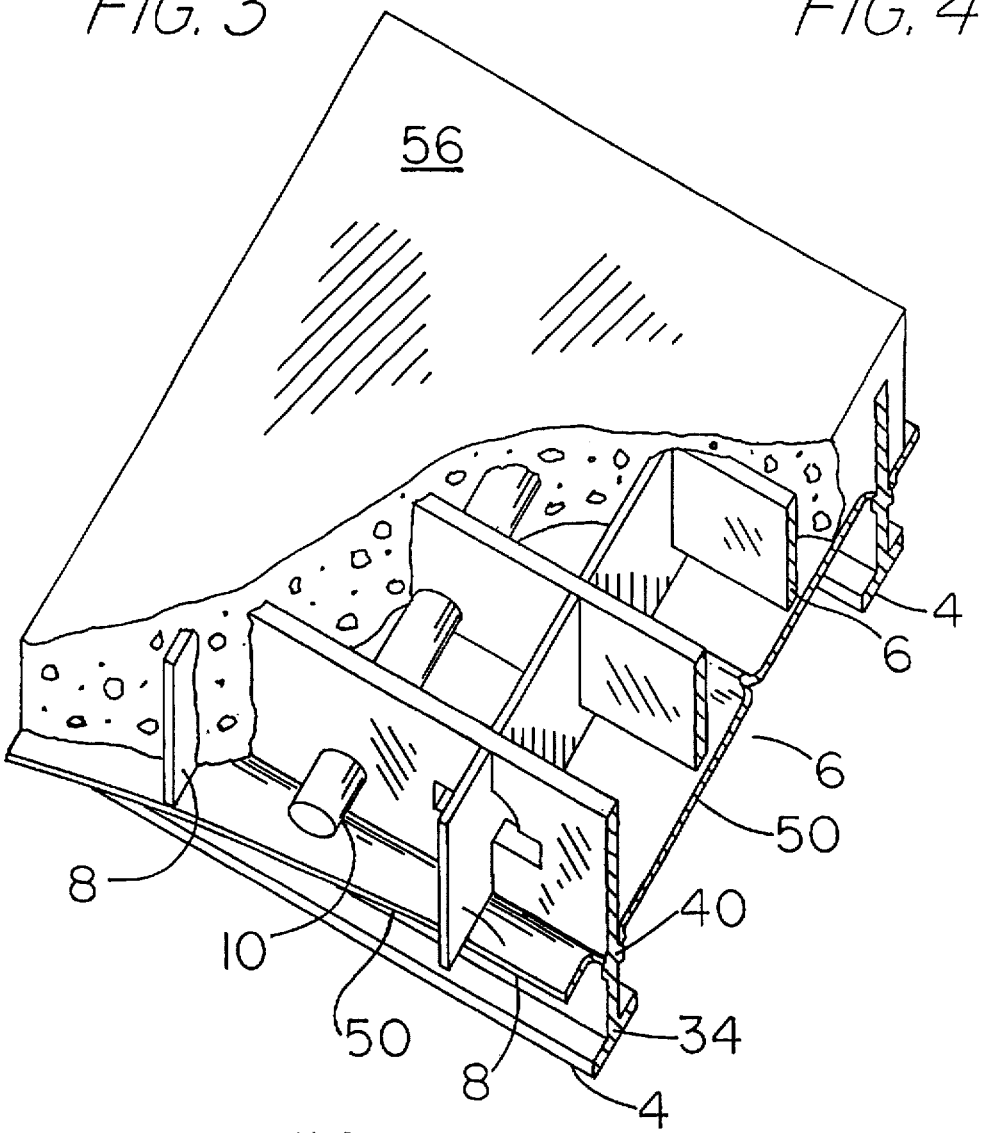
FIG. 5 is a perspective cutaway view of a grating utilizing a deep web with concrete encasing the top portion of the grating.

FIG. 5 is a schematic showing concrete 56 provided in the upper portion of the grating.

It should be understood that while the grating of the invention has been shown encasing a top portion of the grating (FIG. 5), the concrete can extend above and below the grating, if desired. That is, the grating can be substantially encapsulated with concrete.

While the invention has been described with respect to a grating employing a three-bar system and a locking rod, the invention contemplates grating fabricated using two rails such as the primary load bearing bars and secondary load bearing bars. When the grating is fabricated using two rails, then locking rod 10 is inserted through both rails in a diagonal direction.

It will be seen that gratings in accordance with the present invention overcome the disadvantages of welded gratings referred to earlier. However, even though welds can be applied to the grating of the present invention, welding is believed to be more detrimental than advantageous because welding tends to cause embrittlement and, therefore, provides a site for failure such as fatigue failure. However, the term weldless as used herein can include minor welding, for example, if such were used to hold rod 10 in place, and such is contemplated within the purview of the invention.

Further, while the invention has been depicted showing primary load bearing bars having flanges, the invention contemplates gratings fabricated using plain bars for all three load bearing bars; and in certain gratings, the three bars can have the same dimensions.

The gratings of the invention can be fabricated from metals such as steels, carbon steel, stainless steels and aluminum alloys or from plastics such as fiberglass-reinforced plastics.

In the present invention, if steel bars are used, they may be galvanized prior to assembly or after assembly. If galvanized before assembly, touch up may have to be used to cover scratches resulting from assembly. Further, in the present invention, the slots should be dimensioned to provide for a snug fit to minimize collection of debris such as salts that cause corrosion, particularly in open gratings.

While the invention has been described in terms of preferred embodiments, the claims appended hereto are intended to encompass other embodiments which fall within the spirit of the invention.

What is claimed is:

1. A weldless grating comprising:

(a) a plurality of longitudinally extending primary load bearing members having a top, a bottom and a first web located between said top and said bottom, the primary load bearing member having a plurality of spaced-apart openings in said first web, the openings in each of said primary load bearing members being aligned with the openings in adjacent primary load bearing members, the openings having a top portion and a bottom portion, at least one of said top portion and said bottom portion having a protuberance extending from said first web into said opening;

(b) a plurality of secondary load bearing members having an upper edge and a lower edge and a secondary web between the upper edge and lower edge, the secondary load bearing members provided with secondary slots in said secondary web, the secondary load bearing members positioned in the aligned openings in said web of the primary load bearing members, said secondary slots in said secondary load bearing member forming a locking engagement with said protuberances in said openings in said primary load bearing members;

the secondary load bearing members having secondary downwardly extending slots through said upper edge, secondary downwardly extending slots located between primary load bearing members;

(c) a plurality of tertiary load bearing members positioned in the secondary slots in the secondary load bearing members; and (d) a rod extending through said tertiary load bearing members and said primary load bearing members locking said tertiary load bearing members in the secondary downwardly extending slots in said secondary load bearing members and locking said secondary load bearing members in engagement with said protuberance in the openings in said primary load bearing members to form said grating.

2. The grating in accordance with claim 1 wherein said top portion is positioned in opposing relationship to said bottom portion and said top portion has a first protuberance extending from said web into the top portion of said opening and said bottom portion has a second protuberance extending from said web into the bottom portion of said opening, said first protuberance extending from said web in a direction substantially opposite to said second protuberance.

3. The grating in accordance with claim 1 wherein said primary load bearing members and secondary load bearing members have a generally rectangular cross section.

4. The grating in accordance with claim 1 wherein said primary load bearing members are positioned substantially parallel to each other and said secondary load bearing members are positioned transverse to said primary load bearing members.

5. The grating in accordance with claim 1 wherein said top portion of said opening has a first face substantially perpendicular to said top and said protuberance projects from said first face to engage said secondary slots in said secondary load bearing member.

6. The grating in accordance with claim 5 wherein said bottom portion of said opening has a second face substantially perpendicular to said top, said second face having a protuberance which protrudes from said second face to engage said secondary slots in said secondary load bearing member.

7. The grating in accordance with claim 6 wherein said secondary member has a first side and a second side opposed from said first side, said first and second sides disposed substantially perpendicular to said top, said first side positioned against said first face and said second side positioned against said second face, said protuberances on said first and second faces framing a locking engagement with said secondary slots in said secondary load bearing member.

8. The grating in accordance with claim 1 wherein the members comprise steel members.

9. The grating in accordance with claim 1 wherein the members comprise an aluminum alloy member.

10. The grating in accordance with claim 1 wherein the primary load bearing members have flanges located below said bottom edges of said secondary load bearing members, said flanges projecting towards adjacent primary load bearing members and extending longitudinally along said primary load bearing member, said flanges located on an opposite wall of an adjacent primary load bearing members to provide a support for a pan, said pan positioned between said primary load bearing members and resting on said flange to provide a bottom on said grating to contain wet concrete.

11. The grating in accordance with claim 10 wherein said pan is comprised of a longitudinal ridge extending generally parallel to said primary load bearing members and extending generally upwardly towards the lower edge of said secondary load bearing members, said pan further comprised of edges adapted to rest on said flanges, said pan shaped to curve upwardly to said ridge to provide sufficient strength in said pan to contain concrete deposited thereon.

12. A weldless grating comprising:

(a) a plurality of longitudinally extending primary load bearing members having a top, a bottom and a first web located between said top and said bottom, the primary load bearing member having a plurality of spaced-apart openings in said first web, the openings in each of said primary load bearing members being aligned with the openings in adjacent primary load bearing members, the openings having a top portion and a bottom portion, said top portion having a first face substantially perpendicular to said top, said first face having a first protuberance projecting into said opening, said bottom portion having a second face substantially parallel to said first face, said second face having a second protuberance projecting into said opening;

(b) a plurality of generally rectangular shaped secondary load bearing members having an upper edge and a lower edge and a secondary web between the upper edge and lower edge, the secondary load bearing members provided with secondary slots in said secondary web, the secondary load bearing member having a first side and a second side, the secondary load bearing members positioned in the aligned openings in said web of the primary load bearing members, said first side abutting against said first face and said second side abutting against said second face, said secondary slots in said secondary load bearing member forming a locking engagement with said first and second protuberances on said first and second faces in said openings in said primary load bearing members;

the secondary load bearing members having secondary downwardly extending slots through said upper edge, secondary downwardly extending slots located between primary load bearing members;

(c) a plurality of tertiary load bearing members positioned in the secondary slots in the secondary load bearing members; and (d) a rod extending through said tertiary load bearing members and said primary load bearing members locking said tertiary load bearing members in the secondary downwardly extending slots in said secondary load bearing members and locking said secondary load bearing members in engagement with said protuberance in the openings in said primary load bearing members to form said grating.

13. The grating in accordance with claim 12 wherein said primary load bearing members are positioned substantially parallel to each other and second secondary load bearing members are positioned transverse to said primary load bearing members.

14. The grating in accordance with claim 12 wherein said means comprises a rod extending through said secondary load bearing members in substantially parallel relationship to said primary load bearing member.

15. The grating in accordance with claim 12 wherein the members comprise steel members.

16. The grating in accordance with claim 12 wherein the members comprise an aluminum alloy member.

17. The grating in accordance with claim 12 wherein the primary load bearing members have flanges located below said bottom edges of said secondary load bearing members, said flanges projecting towards adjacent primary load bearing members and extending longitudinally along said primary load bearing member, said flanges located on an opposite wall of an adjacent primary load bearing members to provide a support for a pan, said pan positioned between said primary load bearing members and resting on said flange to provide a bottom on said grating to contain wet concrete.

18. The grating in accordance with claim 17 wherein said pan is comprised of a longitudinal ridge extending generally parallel to said primary load bearing members and extending generally upwardly towards the lower edge of said secondary load bearing members, said pan further comprised of edges adapted to rest on said flanges, said pan shaped to curve upwardly to said ridge to provide sufficient strength in said pan to contain concrete deposited thereon.

19. A concrete module comprising a weldless grating at least partially encapsulated in a body of concrete or overlaid with a body of concrete, the weldless grating comprising:

(a) a plurality of longitudinally extending primary load bearing members having a top, a bottom and a first web located between said top and said bottom, the primary load bearing member having a plurality of spaced-apart openings in said first web, the openings in each of said primary load bearing members being aligned with the openings in adjacent primary load bearing members, the openings having a top portion and a bottom portion, at least one of said top portion and said bottom portion having a protuberance extending from said first web into said opening;

(b) a plurality of secondary load bearing members having an upper edge and a lower edge and a secondary web between the upper edge and lower edge, the secondary load bearing members provided with secondary slots in said secondary web, the secondary load bearing members positioned in the aligned openings in said web of the primary load bearing members, said secondary slots in said secondary load bearing member forming a locking engagement with said protuberances in said openings in said primary load bearing members;

the secondary load bearing members having secondary downwardly extending slots through said upper edge, secondary downwardly extending slots located between primary load bearing members;

(c) a plurality of tertiary load bearing members positioned in the secondary slots in the secondary load bearing members; and (d) a rod extending through said tertiary load bearing members and said primary load bearing members locking said tertiary load bearing members in the secondary downwardly extending slots in said secondary load bearing members and locking said secondary load bearing members in engagement with said protuberance in the openings in said primary load bearing members to form said grating.

20. The concrete module in accordance with claim 19 wherein said top portion is positioned in opposing relationship to said bottom portion and said top portion has a first protuberance extending from said web into the top portion of said opening and said bottom portion has a second protuberance extending from said web into the bottom portion of said opening, said first protuberance extending from said web in a direction substantially opposite to said second protuberance.

21. The grating in accordance with claim 19 wherein said primary load bearing members and secondary load bearing members have a generally rectangular cross section.

22. The grating in accordance with claim 19 wherein said primary load bearing members are positioned substantially parallel to each other and said secondary load bearing members are positioned transverse to said primary load bearing members.

23. The grating in accordance with claim 19 wherein said top portion of said opening has a first face substantially perpendicular to said top and said protuberance projects from said first face to engage said secondary slots in said secondary load bearing member.

24. The grating in accordance with claim 23 wherein said bottom portion of said opening has a second face substantially perpendicular to said top, said second face having a protuberance which protrudes from said second face to engage said secondary slots in said secondary load bearing member.

25. The grating in accordance with claim 24 wherein said secondary member has a first side and a second side opposed from said first side, said first and second sides disposed substantially perpendicular to said top, said first side positioned against said first face and said second side positioned against said second face, said protuberances on said first and second faces forming a locking engagement with said secondary slots in said secondary load bearing member.

26. The grating in accordance with claim 24 wherein the members comprise steel members.

27. The grating in accordance with claim 24 wherein the members comprise an aluminum alloy member.

28. The grating in accordance with claim 24 wherein the primary load bearing members have flanges located below said bottom edges of said secondary load bearing members, said flanges projecting towards adjacent primary load bearing members and extending longitudinally along said primary load bearing member, said flanges located on an opposite wall of an adjacent primary load bearing members to provide a support for a pan, said pan positioned between said primary load bearing members and resting on said flange to provide a bottom on said grating to contain wet concrete.

29. The grating in accordance with claim 24 wherein said pan is comprised of a longitudinal ridge extending generally parallel to said primary load bearing members and extending generally upwardly towards the lower edge of said secondary load bearing members, said pan further comprised of edges adapted to rest on said flanges, said pan shaped to curve upwardly to said ridge to provide sufficient strength in said pan to contain concrete deposited thereon.

30. A concrete module comprising a weldless grating at least partially encapsulated in a body of concrete or overlaid with a body of concrete, the weldless grating comprising:

(a) a plurality of longitudinally extending primary load bearing members having a top, a bottom and a first web located between said top and said bottom, the primary load bearing member having a plurality of spaced-apart openings in said first web, the openings in each of said primary load bearing members being aligned with the openings in adjacent primary load bearing members, the openings having a top portion and a bottom portion, said top portion having a first face substantially perpendicular to said upper edge, said first face having a first protuberance projecting into said opening, said bottom portion having a second face substantially parallel to said first face, said second face having a second protuberance projecting into said opening;

(b) a plurality of generally rectangular shaped secondary load bearing members having an upper edge and a lower edge and a secondary web between the upper edge and lower edge, the secondary load bearing members provided with secondary slots in said secondary web, the secondary load bearing member having a first side and a second side, the secondary load bearing members positioned in the aligned openings in said web of the primary load bearing members, said first side abutting against said first face and said second side abutting against said second face, said secondary slots in said secondary load bearing member forming a locking engagement with said first and second protuberances on said first and second faces in said openings in said primary load bearing members;

the secondary load bearing members having secondary downwardly extending slots through said upper edge, secondary downwardly extending slots located between primary load bearing members;

(c) a plurality of tertiary load bearing members positioned in the secondary slots in the secondary load bearing members; and (d) a rod extending through said tertiary load bearing members and said primary load bearing members locking said tertiary load bearing members in the secondary downwardly extending slots in said secondary load bearing members and locking said secondary load bearing members in engagement with said protuberance in the openings in said primary load bearing members to form said grating.

* * * * *